US012779302B2

(12) United States Patent
Deitz

(10) Patent No.: US 12,779,302 B2
(45) Date of Patent: Nov. 3, 2026

(54) EQUIPMENT FOR MODIFIED GAME OF BASEBALL

(71) Applicant: Joseph R. Deitz, Dover-Foxcroft, ME (US)

(72) Inventor: Joseph R. Deitz, Dover-Foxcroft, ME (US)

( * ) Notice: Subject to any disclaimer, the term of this patent is extended or adjusted under 35 U.S.C. 154(b) by 462 days.

(21) Appl. No.: 18/489,786

(22) Filed: Oct. 18, 2023

(65) Prior Publication Data

US 2025/0128133 A1 Apr. 24, 2025

(51) Int. Cl.

| | |
|---|---|
| ***A63B 67/00*** | (2006.01) |
| ***A63B 63/00*** | (2006.01) |
| ***A63B 71/06*** | (2006.01) |

(52) U.S. Cl.

CPC ..... *A63B 67/002* (2013.01); *A63B 63/00* (2013.01); *A63B 71/0619* (2013.01); *A63B 2071/0694* (2013.01); *A63B 2210/50* (2013.01); *A63B 2225/74* (2020.08)

(58) Field of Classification Search

CPC ..... A63B 67/002; A63B 63/00

See application file for complete search history.

(56) References Cited

U.S. PATENT DOCUMENTS 7,621,536 B2 * 11/2009 Orzech ..... A63B 63/00 273/400

* cited by examiner

*Primary Examiner* — Brian O Peters

(74) *Attorney, Agent, or Firm* — Anthony D. Pellegrini

(57) ABSTRACT

Equipment for playing a modified version of baseball where the equipment is used as a proxy for human players, with the equipment including one of more base markers, each of which is positioned proximate to a base or home plate, with each base marker comprised of a target and a support structure configured to support the target, with players throwing a ball at or into a target to establish an out if the target is struck by or receives the ball before a baserunner safely arrives at the base next to the base marker.

27 Claims, 7 Drawing Sheets

EQUIPMENT FOR MODIFIED GAME OF BASEBALL

BACKGROUND OF THE INVENTION

Games using bases and balls, such as baseball, softball, and whiffle ball, are very popular. They are often played in formally structured leagues by teams comprised of a set number of players, with a minimum number of players on the field during game play. These games are also played informally with fewer than the minimum number of players required by official rules. However, when fewer players are on a team, the possibility arises that critical game playing roles are left without a player. For example, in both baseball and softball, there are three bases and home plate, each of which is defended by a player. If there are fewer than four players on an informal team, then at least one of the bases and/or home plate will be undefended. Similarly, players on offense often succeed on reaching a base. As many as three players at a time may be positioned on the bases, one at each base, while a fourth player bats. However, if the offensive team has fewer than four players, it is possible that not all bases will have the respective baserunner positioned thereon. Even when there are four or more players on a team, it may be desirous to not position defensive players at each base, or to not have baserunners positioned at each base.

It is thus shown that there is a need for a system for allowing teams to use equipment to serve as a proxy for players.

It is therefore an object of the present invention to provide equipment for playing a game involving bases and a ball, whereby such equipment serves as a proxy for one or more human players.

It is a further object of the present invention to provide equipment for playing a game involving bases and a ball, whereby such equipment serves as a proxy for one or more defensive players.

It is yet a further object of the present invention to provide equipment for playing a game involving bases and a ball, whereby such equipment serves as a proxy for one or more offensive players.

It is yet a further object of the present invention to provide equipment for playing a game involving bases and a ball, whereby such equipment can be used on an outdoor field.

It is yet a further object of the present invention to provide equipment for playing a game involving bases and a ball, whereby such equipment can be used on an indoor floor.

It is yet a further object of the present invention to provide equipment for playing a game involving bases and a ball, whereby such equipment is collapsible for easy portability and storage.

Other objects of the present invention will be readily apparent from the description that follows.

SUMMARY

The present invention embodies equipment for playing a game involving bases and a ball, such as baseball, softball, or whiffle ball. The equipment is intended to be used consistently with the basic rules of play of these games, though slightly modified rules will be needed to incorporate the equipment. Entirely different games using bases and balls may be devised to take advantage of use of the equipment. In brief, games involving bases and balls typically involve human players going to the bases in a predefined manner, with the ball used to determine (in part) whether the player has succeeded in advancing to a base. In baseball and softball, a player from the defending team defends each base, and the ball may be thrown to the defending player while a player on the offensive team attempts to advance to the defended base. If the advancing player is forced to go to the base and the defending player catches the ball and steps on the base before the advancing player arrives, the advancing player is deemed "out", while if the advancing player arrives at the base ahead of the ball, the advancing player is deemed "safe".

In informal applications of these games, however, the teams may not have sufficient players to defend all of the bases. That is, there may not be a defending player positioned at a base that is available to catch the ball ahead of an advancing player. This is a typical situation in pickup games where only a few players are available. The equipment of the present invention therefore acts as a proxy for a defending player who would otherwise be defending a base. The equipment includes one of more base markers, each of which can be positioned proximate to a base (or home plate). See FIG. 2. The base marker presents a target for the defensive players. The ball is thrown at the target by a defensive player while the player on offense attempts to reach the base where the base marker is located. If the ball strikes the target (or lands inside the target) before the offensive player reaches the base, that player is deemed to have failed to advance to that base (if the game being played is baseball or softball, that player is deemed to be "out"). If the ball fails to strike the target (or land inside the target) before the offensive player reaches the base, that player is deemed to have successfully advanced to that base (if the game being played is baseball or softball, that player is deemed to be "safe"). Thus, the base markers serve as proxies for defending players who would otherwise be defending the bases.

In addition, the equipment may also be used as proxies for offensive players. A player on offense that has successfully advanced to a base may be represented by an indicator on the base marker showing that the baserunner was "safe" and is located on that base. The player may then leave the base in order to play another role in the game, and the indicator serves as the proxy for the baserunner at that base. As an example of play, using baseball rules, if the player at bat hits a single and successfully reaches first base, the indicator of the base marker located at first base is set to indicate that a virtual baserunner is on first base. The player may then return to home plate to bat again. If the player then hits a double and successfully reaches second base, the indicator on the base marker at second base is set to show that a virtual baserunner is on second base, and the indicator on the base marker at third base is also set to show that the virtual baserunner previously on first base is now on third base.

Therefore, by using the equipment of the present invention, a game of baseball (as an example) may be played with fewer than the requisite nine players on each team, with the possibility of one or more of the players designated the first baseman, the second baseman, the third basement, and the catcher being replaced by the base markers, and one or more of the baserunners being replaced by the indicators of the base markers. In fact, each team could have as few as one player, with the lone defensive player fielding all hits and using the base markers to record outs, and the lone baserunner on the offensive team using the indicators on the base markers to show the presence of successful baserunners at any given base.

As described herein, the equipment disclosed in the present application comprises one or more base markers, with each base marker being comprised of a support structure and a target. The support structure is configured to be placed onto the ground (if the game is played outdoors) or onto the floor (if the game is played indoors), and is further configured to support the target above the ground or floor. The target is configured to be vertically oriented with an outer surface that can be struck by a ball, or in the alternative configured to have an internal portion to receive a ball, or both. The indicator of the base marker is visually perceivable by the players, and is switchable between two modes, with one mode indicating the presence of a virtual baserunner on the proximate base and the other mode indicating no baserunner on the proximate base.

In preferred embodiments the support structure may be configured to be either placed onto the ground (or floor) or embedded into the ground, and both the support structure and the target may be collapsible for easier handling and storage. In a preferred embodiment the size of the target and the position of the target above the ground or floor may be adjusted to allow for different degrees of skill needed to play the game (for example, a smaller target will require a higher level of skill to strike it with a thrown ball than a larger target, and a higher positioned target will require a higher level of skill to throw a ball into the target than a lower positioned target).

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims incorporated herein.

DETAILED DESCRIPTION

Figure 2:
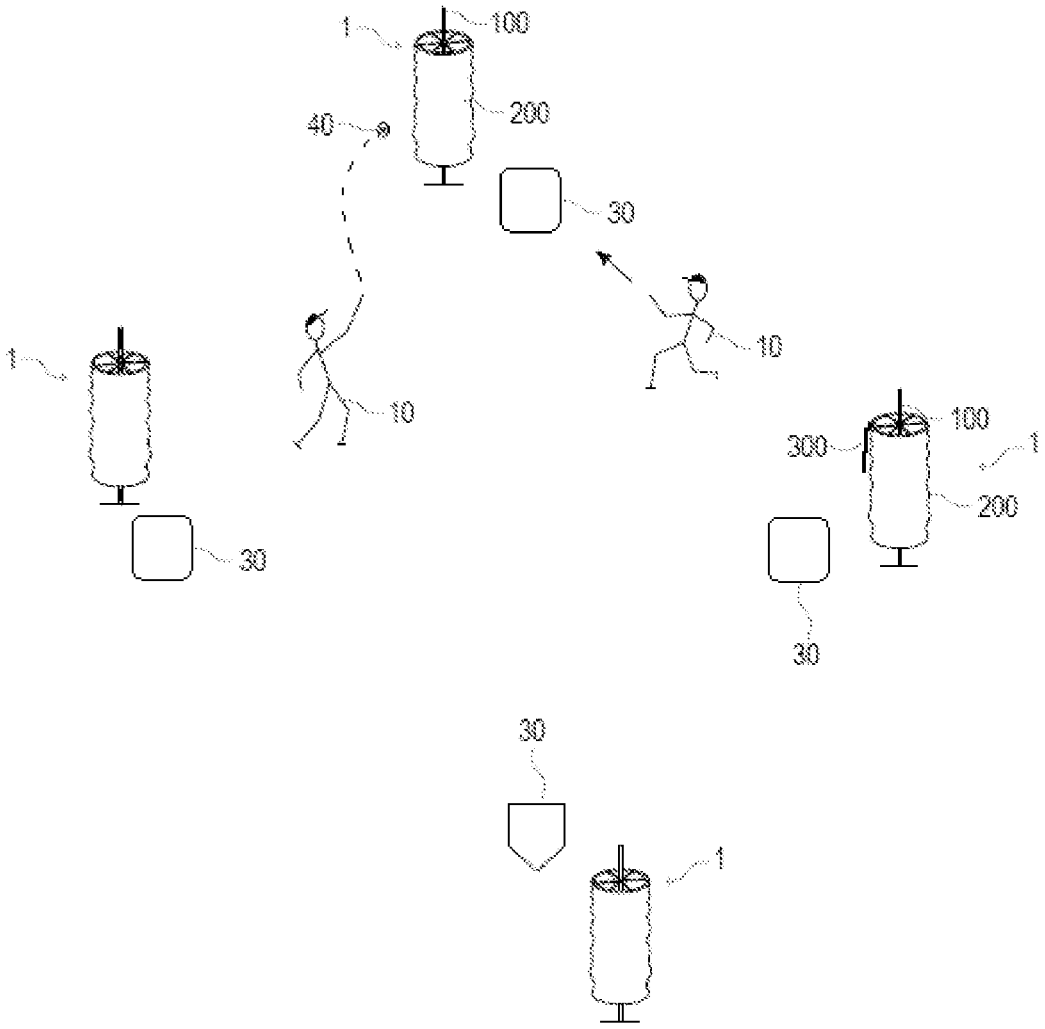
FIG. 2 depicts a game of baseball being played with fewer than a full complement of players, using the equipment of the present invention as proxies for players.

The present invention embodies equipment for playing a game involving bases 30 and a ball 40, such as baseball, softball, or whiffle ball, or other games. The equipment comprises one or more base markers 1, with each base marker 1 being positioned proximate to a base. See FIG. 2. While there may be a correspondence between the number of base markers 1 and the number of bases 30, there may be more or fewer base markers 1 than the total number of bases 30, depending on the needs of the players 10 and the specific rules of the game being played.

Each base marker 1 comprises a support structure 100 and a target 200. The support structure 100 of the base marker 1 is configured to be placed onto or into a playing surface 20, such as the ground or pavement or a floor, in a manner that allows the support structure 100 to remain upright in a substantially vertical orientation relative to the playing surface 20. The support structure 100 is further configured to support the target 200 of the base marker 1 above the playing surface 20. A person playing the game propels the ball 40 towards the target 200 of the base marker 1 per the rules of the game being played. See FIG. 2. A successful play will involve the ball 40 striking the target 200 or landing inside the target 200 before the arrival of a baserunner 10 at the corresponding base.

Figure 1:
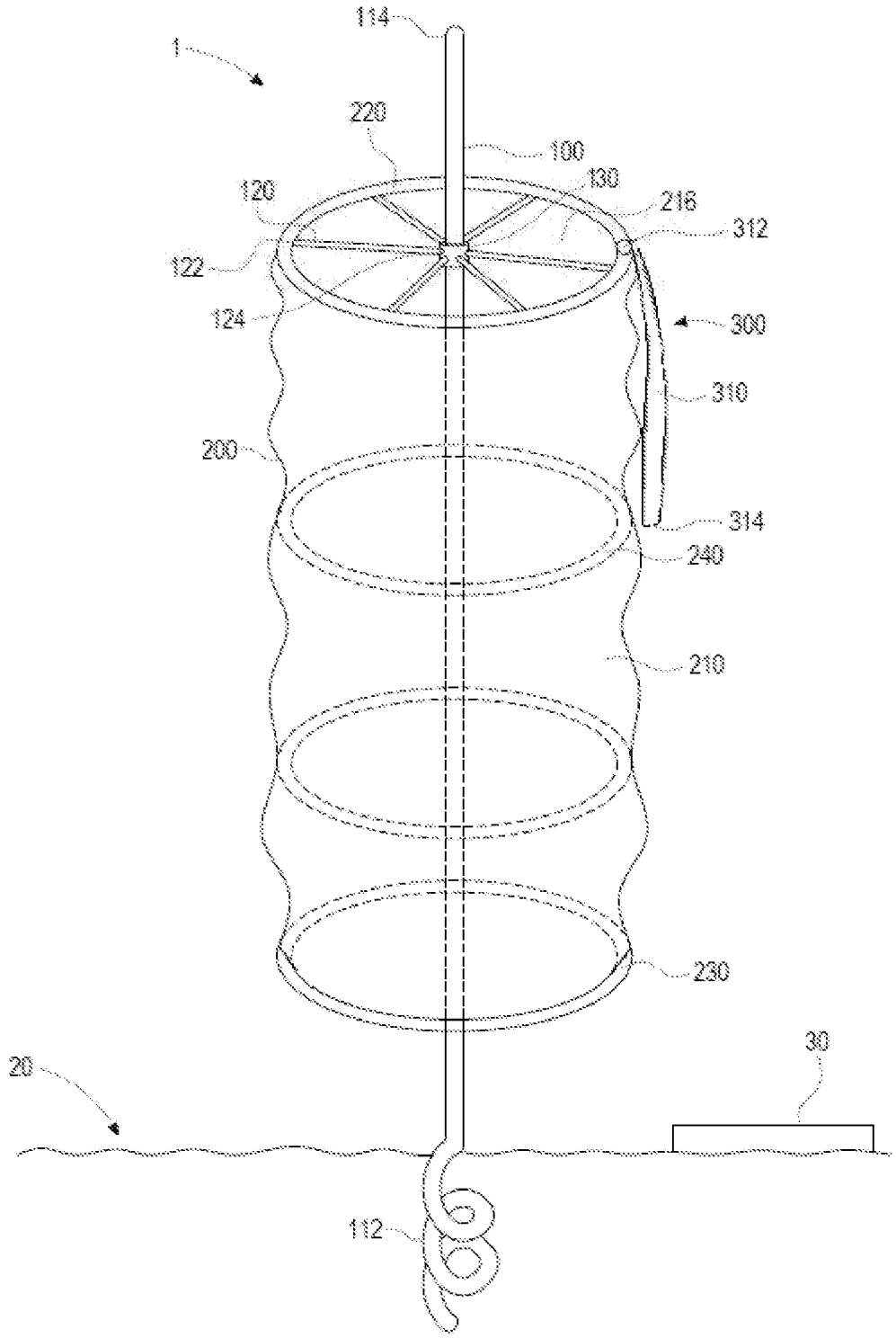
FIG. 1 is an embodiment of the present invention depicting a base marker having a support structure with a first end configured to be placed into the ground and a target configured with multiple intermediate shaping rings and a flag indicator.

The target 200 of each base marker 1 comprises an outer wall 210 and an inner cavity 216 formed by the outer wall 210. See FIG. 1. The outer wall 210 of the target 200 has a top edge 212 and a bottom edge 214 located opposite the top edge 212. In one embodiment, the outer wall 210 of the target 200 is opened at its top end proximate to the top edge 212 and opened at its bottom end proximate to its bottom edge 214. In the preferred embodiment, the outer wall 210 of the target 200 is continuous for the entire perimeter of the target 200, whereby access into the inner cavity 216 of the target 200 is only through the opened top end or through the opened bottom end. In other embodiments, the outer wall 210 of the target 200 may have a discontinuity, whereby access into the inner cavity 216 of the target 200 is through the opened top end, through the opened bottom end, or through the discontinuity of the outer wall 210. In another embodiment, the target 200 provides a closed bottom, such that the inner cavity 216 is opened at its top end and closed at its bottom end, thereby allowing the target 200 to retain a ball 40 that is propelled into the inner cavity 216 of the target 200.

The outer wall 210 of the target 200 of the base marker 1 may be made of a flexible material. This flexible material may be any sort of cloth fabric, such as nylon, polyester, cotton, canvas, silk, synthetic fabrics, blended fabrics, space blanket material, and Styrofoam sheeting, or other such materials. It may also be a flexible plastic material, such as Mylar® or plastic sheeting. It may be comprised of mesh or netting. In other embodiments, the target 200 may be made of a rigid material, such as cardboard, plastic, or aluminum, typically formed into a tube.

In preferred embodiments where the outer wall 210 of the target 200 is made of a flexible material, the target 200 further comprises an upper shaping member 220 and a lower shaping member 230. See FIG. 1. The shaping members 220,230 are configured to provide structure to the target 200. The upper shaping member 220 is attached to the top edge 212 of the outer wall 210 of the target 200. The lower shaping member 230 is attached to the bottom edge 214 of the outer wall 210 of the target 200. The lower shaping member 230 may be weighted to assist in fully extending the outer wall 210. The upper shaping member 220 is a rigid or semi-rigid ring having a particular shape. The shape may be circular, ovoid, rectangular, triangular, hexagonal, pentagonal, octagonal, or any other regular shape, or even an irregular shape, such as a star or flower pattern. In the preferred embodiment, the upper shaping member 220 is continuous, though in other embodiments the upper shaping member 220 may have a discontinuity. The lower shaping member 230 is shaped and dimensioned substantially the same as the upper shaping member 220. So configured, the outer wall 210 of the target 200 is disposed between the upper shaping member 220 of the target 200 and the lower shaping member 230 of the target 200.

In a preferred embodiment, the target 200 of each base marker 1 further comprises one or more intermediate shaping members 240. See FIG. 1. Each intermediate shaping member 240 is shaped and dimensioned substantially the same as the upper and lower shaping members 220,230 as described above. Each intermediate shaping member 240 is located between the upper shaping member 220 of the target 200 and the lower shaping member 230 of the target 200 and attached to the outer wall 210 of the target 200. The intermediate shaping members 240 may be dispersed regularly along the outer wall 210 of the target 200 or may be dispersed in an irregular pattern. The use of the intermediate shaping members 240 gives additional structure to a target 200 made of a flexible material. The intermediate shaping members 240 therefore may be made out of any suitable material that is capable of providing structure to the target 200, such as: plastic, PVC, steel, aluminum, other metals, rubber, Styrofoam, fiberglass, braided/rigid/waxed rope, rigid cardboard, wood, bamboo, and reed.

Figure 3:
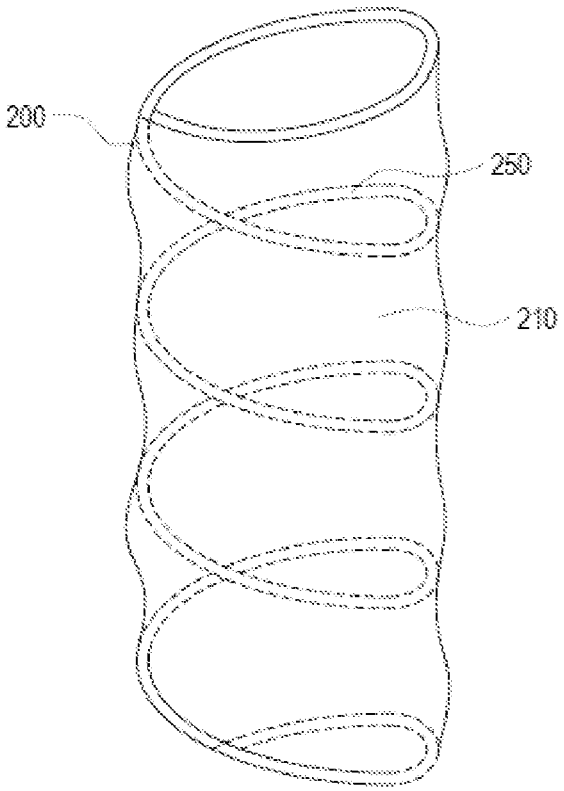
FIG. 3 is an embodiment of the present invention depicting the target of a base marker having an intermediate shaping coil.

In an alternative embodiment, the target 200 of each base marker 1 comprises a single intermediate shaping coil 250. See FIG. 3. The intermediate shaping coil 250 has a spiral shape and is disposed between the upper shaping member 220 of the target 200 and the lower shaping member 230 of the target 200, with the intermediate shaping coil 250 being attached to the outer wall 210 of the target 200. Use of the intermediate shaping coil 250 gives an alternative means of providing additional structure to a target 200 made of a flexible material. The intermediate shaping coil 250 therefore may be made out of any suitable material that is capable of providing structure to the target 200, such as: plastic, PVC, steel, aluminum, other metals, rubber, Styrofoam, fiberglass, braided/rigid/waxed rope, rigid cardboard, wood, bamboo, and reed.

Figure 4A:
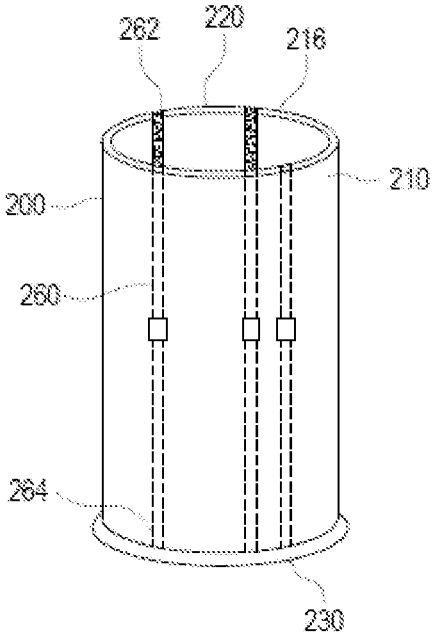
FIG. 4A is an embodiment of the present invention depicting the target of a base marker having internal adjustment straps (shown in ghost line), showing the target in deployed mode.
Figure 4B:
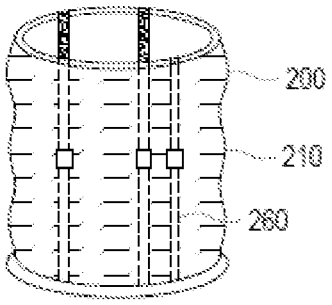
FIG. 4B is an embodiment of the present invention shown in FIG. 4A depicting the target of a base marker having internal adjustment straps (shown in ghost line), showing the target in semi-collapsed mode.
Figure 4C:
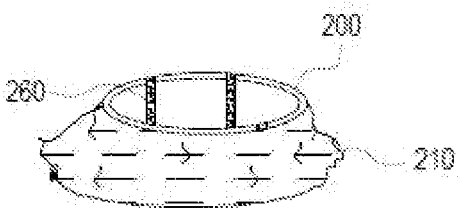
FIG. 4C is an embodiment of the present invention shown in FIG. 4A depicting the target of a base marker having internal adjustment straps, showing the target in collapsed mode.

If the outer wall 210 of the target 200 of each base marker 1 is made of a flexible material, the target 200 may have a deployed mode and a collapsed mode. In the deployed mode, the outer wall 210 of the target 200 is fully extended such that the upper shaping member 220 of the target 200 is at substantially a maximum distance from the lower shaping member 230 of the target 200. See FIG. 4A. In the collapsed mode, the outer wall 210 of the target 200 is gathered up such that the upper shaping member 220 of the target 200 is brought close to the lower shaping member 230 of the target 200. See FIG. 4C. In the preferred embodiment, the target 200 is made of a very light weight material that can be gathered up so that the upper shaping member 220 and the lower shaping member 230 can be brought into near contact with each other in collapsed mode (or, if there are intermediate shaping members 240, then the upper shaping member 220 can be brought into near contact with the nearest intermediate shaping member 240 to it and the lower shaping member 230 can be brought into near contact with the nearest intermediate shaping member 240 to it, with the intermediate shaping members 240 being brought into near contact with each other). In the embodiments where an intermediate shaping coil 250 is used, the intermediate shaping coil 250 of the target 200 is comprised of a flexible material and can be compressed to achieve collapsed mode and extended to achieve deployed mode. The lower shaping member 230 may be weighted to help straighten out the intermediate shaping coil 250 in deployed mode.

In embodiments where the target 200 is made of a flexible material, the target 200 may further have a semi-collapsed mode. In the semi-collapsed mode, the outer wall 210 of the target 200 is partially collapsed such that the upper shaping member 220 of the target 200 is closer to the lower shaping member 230 of the target 200 than when the target 200 is in the deployed mode, and the upper shaping member 220 of the target 200 is further from the lower shaping member 230 of the target 200 than when the target 200 is in the collapsed mode. See FIG. 4B. The semi-collapsed mode may be achieved by the use of a plurality of adjustable straps 260, with each strap 260 having a first end 262 and a second end 264. The straps 260 are placed into the inner cavity 216 of the target 200, with the first end 262 of each strap 260 attached to the upper shaping member 220 of the target 200 and the second end 264 of each strap 260 attached to the lower shaping member 230 of the target 200. By adjusting the lengths of the straps 260, the distance between the upper and lower shaping members 220,230 can be set as desired. Other means for achieving the semi-collapsed mode are also contemplated. The use of the semi-collapsed mode allows for the size of the target 200 to be adjusted to reflect the desired skill level of the game.

Figure 6:
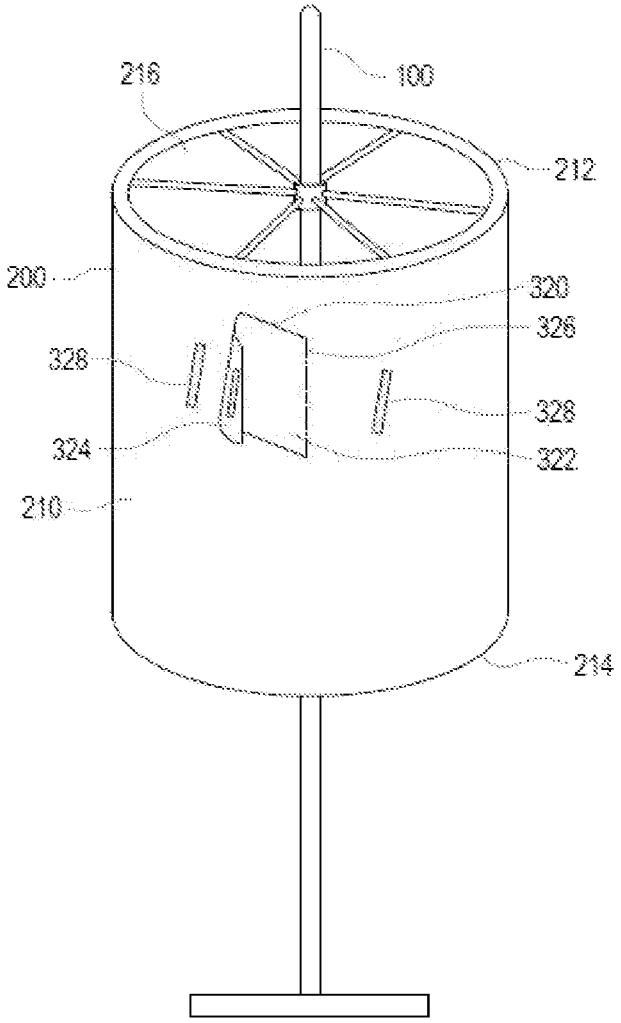
FIG. 6 is an embodiment of the present invention depicting a base marker having a support structure with a first end configured to be placed onto the ground and a target configured with a hinged panel indicator.

Each base marker 1 may further comprise an indicator 300. See FIGS. 1 and 6. The indicator 300 is configured to indicate a first mode and a second mode, with the first mode being visually distinct from the second mode. The indicator 300 is visually perceptible while in the first mode. In one embodiment, the indicator 300 is a flag 310. See FIG. 1. The flag 310 has an attachment end 312 and a free end 314, with the attachment end 312 of the flag 310 being attached to the target 200 proximate to the top edge 212 of the outer wall 210 of the target 200. To place the flag 310 in first mode, the free end 314 of the flag 310 is placed along the outer wall 210 of the target 200 on the exterior side of the outer wall 210. To place the flag 310 in second mode, the free end 314 of the flag 310 is placed into the inner cavity 216 of the target 200. The free end 314 of the flag 310 may be weighted so that it is less prone to being inadvertently blown by the wind into an undesired mode. In the preferred mode, the flag 310 should have a color or a pattern that is visually distinct from the color or pattern of the outer wall 210 of the target 200.

Another embodiment of the indicator 300 comprises a hinged panel 320. See FIG. 6. The panel 320 may be of any suitable shape, as long as it has at least one straight edge to act as a hinged edge 326. In the preferred embodiment the panel 320 is rectangular. The hinged edge 326 is attached to the outer wall 210 of the target 200. The panel 320 can then be moved back and forth against the outer wall 210 of the target 200 on either side of the hinged edge 326. The panel 320 has two faces 322,324, each on an opposite side of the panel 320 from the other. The first face 322 of the panel 320 is designated the face corresponding to the first mode, and the second, opposite face 324 of the panel 320 is designated the face corresponding to the second mode. The two faces 322,324 of the panel 320 are colored or patterned differently, so that each face 322,324 of the panel 320 presents a distinct visual indication. The first face 322 of the panel 320 should have a color or a pattern that is visually distinct from the color or pattern of the outer wall 210 of the target 200. The second face 324 of the panel 320 may have a color or a pattern that is similar to the color or pattern of the outer wall 210 of the target 200. When the panel 320 is moved such that the second face 324 is positioned against the outer wall 210 of the target 200, the first face 322 is visible and the indicator 300 is in first mode. When the panel 320 is moved such that the first face 322 is positioned against the outer wall 210 of the target 200, the second face 324 is visible and the indicator 300 is in second mode. The panel 320 may also have a securing mechanism to maintain it in the desired position. In one embodiment the panel 320 comprises a hook-and-loop fastener strip 328 (such as a Velcro® strip) on each face 322,324 which can engage with a pair of corresponding hook-and-loop fastener strips 328 located on the outer wall 210 of the target 200, one fastener strip on each side of the hinged edge 326 of the panel 320. Other means for securing the panel 320 in its desired position are also contemplated.

Figure 7A:
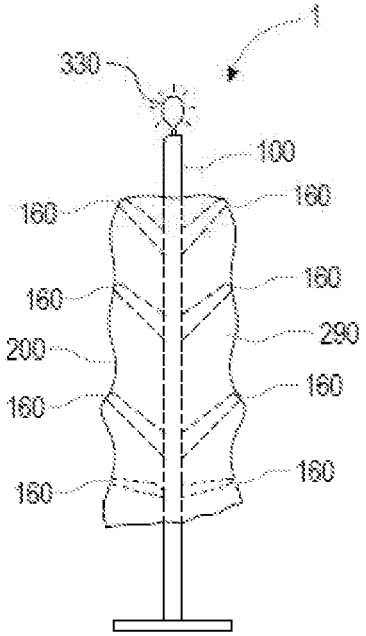
FIG. 7A is another embodiment of the present invention depicting a base marker having a support structure with a plurality of ribs extending therefrom and a target comprised of a flexible sleeve configured to be placed over the plurality of ribs.

In yet another embodiment of the indicator 300, the indicator 300 is a light 330. See FIG. 7A. The light 330 has an illuminated mode and a non-illuminated mode. The indicator 300 indicates the first mode when the light 330 is in illuminated mode, and the indicator 300 indicates the second mode when the light 330 is in non-illuminated mode. Alternatively, the light 330 has a first illuminated mode and a second illuminated mode, with the second illuminated mode being visually distinct from the first illuminated mode. The indicator 300 indicates the first mode when the light 330 is in first illuminated mode, and the indicator 300 indicates the second mode when the light 330 is in second illuminated mode. The light 330 may be placed onto the base marker 1, or merely placed near the base marker 1. In the preferred embodiment, the light 330 is mounted on the top of the support structure 100.

The support structure 100 of each base marker 1 may be made out of any suitable material that is capable of allowing the support structure 100 to support the target 200 above the playing surface 20. Examples of suitable materials include: plastic, PVC, steel, aluminum, other metals, fiberglass, wood, and bamboo.

In one embodiment of the present invention, the support structure 100 of each base marker 1 is at least partially located within the inner cavity 216 of the target 200 of the base marker 1. The target 200 is then attached to the support structure 100 by a plurality of attachment members 120. Each attachment member 120 has a first end 122 and a second end 124, and each such attachment member 120 is attached at its first end 122 to the upper shaping member 220 of the target 200 and attached at its second end 124 to the support structure 100. See FIG. 1. In the preferred embodiments, each attachment member 120 is the same length as each other attachment member 120, so that the support structure 100 is positioned substantially at the center of the inner cavity 216 of the target 200. The attachment members 120 may be flexible cords or straps or chains, or rigid rods or flanges or plates. In other embodiments, there may be additional attachment members 120 running from the lower shaping member 230 to the support structure 100, or additional attachment members 120 running from one or more of the intermediate shaping members 240 to the support structure 100, or both.

In a preferred embodiment, the attachment members 120 are attached to an annular hub 130 secured to the support structure 100. See FIG. 1. The hub 130 is placed onto the support structure 100 and secured thereto, and the second ends 124 of the attachment members 120 are attached to the hub 130 (with the first ends 122 of the attachment members 120 attached to the upper shaping member 220). In the most preferred embodiment, the hub 130 is moveably attached to the support structure 100, such that it may be positioned along the length of the support structure 100 between the first and second ends 112,114 of the support structure 100, as desired. Movement of the hub 130 along the support structure 100 allows for varying the height of the target 200 above the playing surface 20. In one embodiment, the hub 130 is moveably secured to the support structure 100 by frictional forces. In another embodiment, the hub 130 is moveably secured to the support structure 100 by a set screw or a spring-loaded clamp. Other means for moveably securing the hub 130 to the support structure 100 are also contemplated. In other embodiments there may be multiple hubs 130, each configured as described above, with additional hubs 130 attached by attachment members 120 to the lower shaping member 230 and/or one or more of the intermediate shaping members 240. Where there is a moveable hub 130 attached to the upper shaping member 220 and a second moveable hub 130 attached to the lower shaping member 230, moving the two hubs 130 toward each other can result in an alternate method for placing the target 200 into collapsed mode or semi-collapsed mode.

In another embodiment of the present invention, the support structure 100 of each base marker 1 is located exterior to the inner cavity 216 of the target 200 of that base marker 1. The second end 114 of the support structure 100 extends outward from the rest of the support structure 100 and the target 200 is suspended from the second end 114 of the support structure 100. In this embodiment, the second ends 124 of the attachment members 120 are attached to the second end 114 of the support structure 100. The second end 114 of the support structure 100 may be configured as a hook, or an angled bracket, or otherwise.

The support structure 100 of each base marker 1 is configured to engage with the playing surface 20. In one embodiment, the first end 112 of the support structure 100 is configured to be inserted into the playing surface 20. See FIG. 1. This embodiment is intended for use when the playing surface 20 is the ground, such as a playing field or a section of beach or some other surface that may be easily penetrated. In this embodiment, the first end 112 of the support structure 100 may be a spike or a plurality of spikes, a rigid spiral coil, or some other configuration suitable to be placed into the playing surface 20. In other embodiments, the first end 112 of the support structure 100 is configured to be placed onto the playing surface 20. This embodiment may be used with any type of playing surface 20, but in particular flooring or pavement. In this embodiment the first end 112 of the support structure 100 of each base marker 1 may be a planar foot oriented perpendicular to the support structure 100, a weighted member with a planar underside, or a weighted member with a convex underside (this last configuration allows the base marker 1 to "wobble" when struck by a ball 40, thereby providing additional visual indication of that occurrence).

Figure 5A:
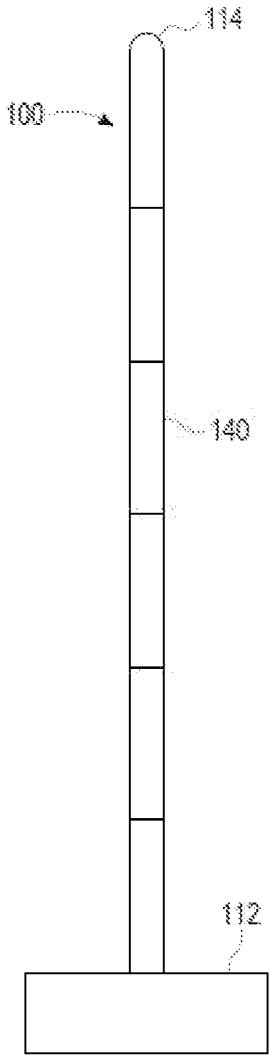
FIG. 5A is an embodiment of the present invention depicting the support structure of a base marker comprised of a plurality of hollow rods removeably fit into each other.
Figure 5B:
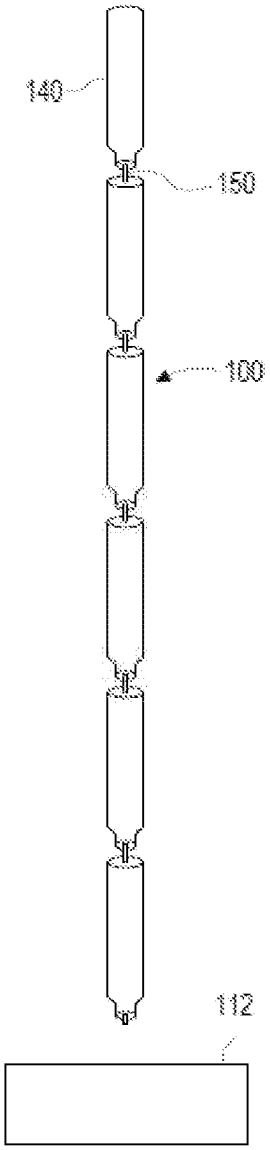
FIG. 5B is an embodiment of the present invention shown in FIG. 5A depicting the support structure being removed and the individual rods being separated from each other, showing the elastic cord holding the rods together.
Figure 5C:
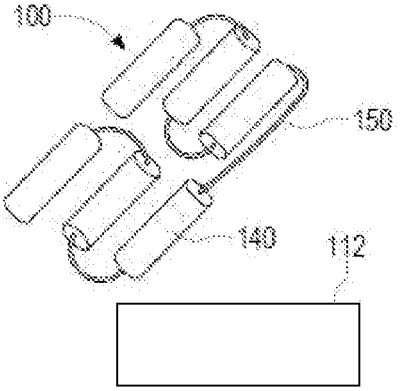
FIG. 5C is an embodiment of the present invention shown in FIG. 5A depicting the support structure having been completely collapsed, showing the elastic cord continuing to hold the rods together.

In the preferred embodiments, the support structure 100 is collapsible. In one such embodiment, the support structure 100 is telescoping. In this embodiment, the support structure 100 is comprised of a plurality of sections of differing dimension that fit into each other. These sections may be held in position relative to each other by frictional forces; alternatively, there may be a spring-loaded tab on each section that fits into an aperture on the adjoining section to retain the sections in place. In another such embodiment, the support structure 100 is foldable, with each section hinged to an adjoining section, with a latching mechanism to retain the sections in an unfolded configuration. In another such embodiment, the support structure 100 is comprised of a plurality of hollow rods 140 that are configured to removeably fit into each other. See FIG. 5A. These hollow rods 140 may be secured to each other by frictional forces or may have mechanical components to hold them together. Alternatively, there may be an elastic cord 150 that runs through the interiors of the hollow rods 140, with one end of the elastic cord 150 attached to the first end 112 of the support structure 100 and the other end of the elastic cord 150 attached to the second end 114 of the support structure 100, thereby holding the hollow rods 140 together. See FIG. 5B. When disassembly is desired, the hollow rods 140 are separated from each other, but are retained together by the elastic cord 150, much in the same way as certain tent pole are configured. See FIG. 5C.

The base markers 1 may have alternate configurations. In one such alternate configuration, each base marker 1 comprises a plurality of support structures 100. The first end 112 of each support structure 100 is configured to engage with the playing surface 20. An example of this embodiment is where there are three support structures 100 set up as a tripod, with the target 200 attached to at least one of the respective second ends 114 of the three support structures 100. This configuration provides added stability to the base marker 1.

Figure 7B:
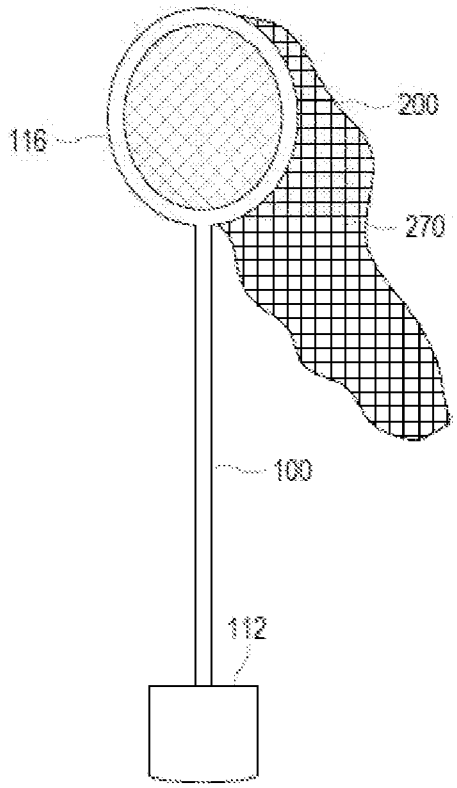
FIG. 7B is another embodiment of the present invention depicting a base marker having a support structure with a vertical ring extending from the second end of the support structure and a target comprised of a closed ended net with the open end of the net attached to the vertical ring of the support structure.

In another alternate configuration, the second end 114 of the support structure 100 is a vertically oriented ring 116, and the target 200 is a closed net 270 attached to the vertically oriented ring 116. See FIG. 7B. In this configuration, a ball 40 successfully engages with the target 200 by being propelled into and retained by the net 270.

Figure 7C:
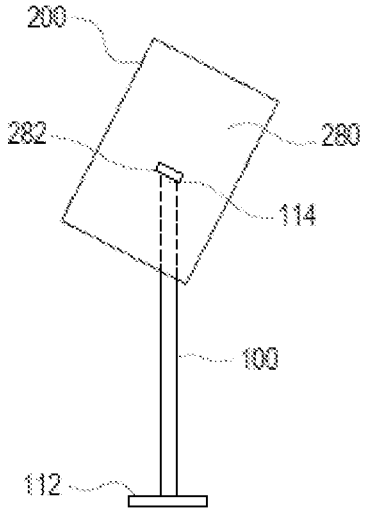
FIG. 7C is another embodiment of the present invention depicting a base marker having a target comprised of a pivoting plate hingedly attached to the second end of the support structure.

In yet another alternate configuration, the target 200 of the base marker 1 is a planar member 280 pivotally attached to the second end 114 of the support structure 100. See FIG. 7C. A portion of the planar member 280 extends above the second end 114 of the support structure 100 while another portion of the planar member 280 extends below the second end 114 of the support structure 100. When a ball 40 strikes the planar member 280, it pivots on a hinge 282 relative to the support structure 100, thereby providing a visual indication of that occurrence. The planar member 280 may be weighted to allow it to return to its original orientation. The target 200 in this configuration may also comprise a bell, such that when the planar member 280 moves upon being struck by a ball 40 the bell sounds, thereby providing an auditory indication of the occurrence along with the visual indication.

In yet another alternate configuration, the support structure 100 further comprises a plurality of ribs 160 extending radially outward from the support structure 100. See FIG. 7A. These ribs 160 should be rigid or semi-flexible, and each should be substantially the same length as the others. The ribs 160 are preferably foldable against the support structure 100. The target 200 in this embodiment is a flexible sleeve 290 that is slipped over the plurality of ribs 160. In this embodiment, there is no need for shaping members 220,230 to give the target 200 structure, because the ribs 160 provide structure to the target 200. However, an upper shaping member 220 and a lower shaping member 230 may be provided, with the upper shaping member 220 acting as a point of attachment for the attachment members 120, as described above, and the lower shaping member 230 being weighted to keep the flexible sleeve 290 of the target 200 at full extension.

Modifications and variations can be made to the disclosed embodiments of the present invention without departing from the subject or spirit of the invention as defined in the following claims.

I claim:

1. Equipment for playing a game involving bases and a ball, said equipment comprising one or more base markers, each base marker being positioned proximate to a base, wherein each said base marker comprises a support structure and a target, wherein the support structure of said base marker is configured to engage with a playing surface and is further configured to support the target of said base marker above said playing surface, and each base marker further comprises an indicator, said indicator configured to indicate a first mode and a second mode, with said first mode being visually distinct from said second mode, and with said indicator being visually perceptible while in the first mode;

whereby a person playing said game propels said ball towards the target of said base marker.

2. The equipment of claim 1 wherein the target of each base marker comprises an outer wall having a top edge and a bottom edge opposite the top edge, and an inner cavity formed by said outer wall.

3. The equipment of claim 2 wherein the support structure of each base marker is located exterior to the inner cavity of the target of said base marker.

4. The equipment of claim 3 wherein the support structure of each base marker is elongate and substantially rigid and has a first end and a second end located opposite the first end, and the second end of said support structure extends at an angle from said support structure and said target is suspended from the second end of said support structure.

5. The equipment of claim 2 wherein the target of each base marker further comprises an upper shaping member and a lower shaping member, wherein the upper shaping member is attached to the top edge of the outer wall of said target and the lower shaping member is attached to the bottom edge of the outer wall of said target, with the upper shaping member being a rigid ring having a shape and a dimension and the lower shaping member being a rigid ring having substantially the same shape and dimension as the upper shaping member, whereby the outer wall of said target is disposed between the upper shaping member of said target and the lower shaping member of said target.

6. The equipment of claim 5 wherein the outer wall of the target of each base marker is comprised of a flexible material.

7. The equipment of claim 6 wherein the target of each base marker comprises a deployed mode and a collapsed mode, whereby in the deployed mode the outer wall of said target is fully extended such that the upper shaping member of said target is at a maximum distance from the lower shaping member of said target, and in the collapsed mode the outer wall of said target is collapsed such that the upper shaping member of said target is proximate to the lower shaping member of said target.

8. The equipment of claim 7 wherein the target of each base marker further comprises a semi-collapsed mode, whereby in the semi-collapsed mode the outer wall of said target is partially collapsed such that the upper shaping member of said target is closer to the lower shaping member of said target than when said target is in the deployed mode, and the upper shaping member of said target is further from the lower shaping member of said target than when said target is in the collapsed mode.

9. The equipment of claim 5 wherein the target of each base marker further comprises an intermediate shaping coil, wherein the intermediate shaping coil is disposed between the upper shaping member of said target and the lower shaping member of said target, with the intermediate shaping coil being attached to the outer wall of said target.

10. The equipment of claim 9 wherein the outer wall of the target of each base marker is comprised of a flexible material and the intermediate shaping coil of said target is comprised of a flexible material.

11. The equipment of claim 10 wherein the target of each base marker comprises a deployed mode and a collapsed mode, whereby in the deployed mode the outer wall of said target is fully extended such that the upper shaping member of said target is at a maximum distance from the lower shaping member of said target, and in the collapsed mode the outer wall of said target is collapsed and the intermediate shaping coil of said target is collapsed, such that the upper shaping member of said target is proximate to the lower shaping member of said target.

12. The equipment of claim 11 wherein the target of each base marker further comprises a semi-collapsed mode, whereby in the semi-collapsed mode the outer wall of said target is partially collapsed and the intermediate shaping coil of said target is partially collapsed, such that the upper shaping member of said target is closer to the lower shaping member of said target than when said target is in the deployed mode, and the upper shaping member of said target is further from the lower shaping member of said target than when said target is in the collapsed mode.

13. The equipment of claim 5, wherein the support structure of each base marker is at least partially located within the inner cavity of the target of said base marker, and said target is attached to said support structure by a plurality of attachment members, with each attachment member having a first end and a second end, and each such attachment member being attached at its first end to the upper shaping member of said target and being attached at its second end to said support structure.

14. The equipment of claim 13, wherein the support structure of each base marker further comprises a hub, wherein said hub is configured to be placed onto said support structure and moveably secured thereto, with the second ends of the plurality of attachment members being attached to the hub of said support structure, whereby the hub of said support structure is configured to be positioned along said support structure at locations between the first end and the second end of said support structure, thereby varying the height of the target above the playing surface.

15. The equipment of claim 1, wherein said indicator is a hinged panel, said panel having a first face, a second face, and a hinged edge, with the first face being visually distinct from the second face, with said hinged panel being attached at its hinged edge to an exterior of the outer wall of the target of said base marker, whereby the indicator indicates the first mode when the hinged panel is positioned such that the second face of the hinged panel is positioned against the outer wall of the target of said base marker so that the first face of the hinged panel is visible, and the indicator indicates the second mode when the hinged panel is positioned such that the first face of the hinged panel is positioned against the outer wall of the target of said base marker so that the second face of the hinged panel is visible.

16. The equipment of claim 1, wherein said indicator is a light, said light having a first illuminated mode and a second illuminated mode, with the light being visually perceptible when in the first illuminated mode, and with the light in the second illuminated mode being either differently visually perceptible than when in the first illuminated mode or non-illuminated;

whereby the indicator indicates the first mode when the light is in the first illuminated mode, and the indicator indicates the second mode when the light is in the second illuminated mode.

17. The equipment of claim 1 wherein the support structure of each base marker is elongate and substantially rigid and has a first end and a second end located opposite the first end, wherein the first end of the support structure of each base marker is configured to engage with the playing surface, and the target of said base marker is configured to engage with said support structure at a location proximate to the second end of said support structure.

18. The equipment of claim 17, wherein the support structure of each base marker is telescoping.

19. The equipment of claim 17, wherein the support structure of each base marker is foldable.

20. The equipment of claim 17, wherein the support structure of each base marker is comprised of a plurality of rods that are configured to fit into each other and further configured to be removed from each other.

21. The equipment of claim 20, wherein the support structure of each base marker is further comprised of an elastic cord, and the plurality of rods comprising said support structure each have hollow interiors, wherein the elastic cord runs through the hollow interiors of each of the plurality of rods.

22. The equipment of claim 1 wherein each base marker comprises a plurality of support structures, with each said support structure being elongate and substantially rigid and having a first end and a second end located opposite the first end, wherein the first end of each support structure of said base marker is configured to engage with the playing surface, and the target of said base marker is configured to engage with said plurality of support structures.

23. The equipment of claim 1 wherein the support structure of each base marker is elongate and substantially rigid and has a first end and a second end located opposite the first end, wherein the first end of the support structure of each base marker is configured to engage with the playing surface, the second end of said support structure is a vertically oriented ring, and the target of said base marker is a closed net attached to said vertically oriented ring.

24. The equipment of claim 1 wherein the support structure of each base marker is elongate and substantially rigid and has a first end and a second end located opposite the first end, wherein the first end of the support structure of each base marker is configured to engage with the playing surface, and the target of said base marker is a planar member hingedly attached to the second end of said support structure.

25. The equipment of claim 1 wherein the support structure of each base marker is elongate and substantially rigid and has a first end, a second end located opposite the first end, and a plurality of ribs extending outward therefrom, wherein the first end of the support structure of each base marker is configured to engage with the playing surface, and the target of said base marker is a flexible sleeve that is placed over the plurality of ribs of said support structure.

26. Equipment for playing a game involving bases and a ball, said equipment comprising one or more base markers, each base marker being positioned proximate to a base, wherein each said base marker comprises a support structure and a target, wherein the support structure of each said base marker is configured to engage with a playing surface and is further configured to support the target of said base marker above said playing surface, and the target of each base marker comprises an outer wall having a top edge and a bottom edge opposite the top edge and an inner cavity formed by said outer wall, wherein the target of each base marker further comprises an upper shaping member, a lower shaping member, and one or more intermediate shaping members, with the upper shaping member being a rigid ring having a shape and a dimension, the lower shaping member being a rigid ring having substantially the same shape and dimension as the upper shaping member, and each intermediate shaping member being a rigid ring having substantially the same shape and dimension as the upper shaping member, wherein the upper shaping member is attached to the top edge of the outer wall of said target, the lower shaping member is attached to the bottom edge of the outer wall of said target, and each intermediate shaping member is located between the upper shaping member of said target and the lower shaping member of said target, with each intermediate shaping member attached to the outer wall of said target, whereby the outer wall of said target is disposed between the upper shaping member of said target and the lower shaping member of said target; and a person playing said game propels said ball towards the target of said base marker.

27. Equipment for playing a game involving bases and a ball, said equipment comprising one or more base markers, each base marker being positioned proximate to a base, wherein each said base marker comprises a support structure and a target, wherein the support structure of said base marker is configured to engage with a playing surface and is further configured to support the target of said base marker above said playing surface, the target of each base marker comprises an outer wall having a top edge and a bottom edge opposite the top edge and an inner cavity formed by said outer wall, and each base marker further comprises an indicator, said indicator configured to indicate a first mode and a second mode, with said first mode being visually distinct from said second mode, and with said indicator being visually perceptible while in the first mode, with said indicator being a flag, said flag having an attachment end and a free end, with said flag being attached at its attachment end to the target proximate to the top edge of the outer wall of the target of said base marker, whereby the indicator indicates the first mode when the free end of the flag is placed against an exterior of the outer wall of said target, and the indicator indicates the second mode when the free end of the flag is placed into the inner cavity of said target;

whereby a person playing said game propels said ball towards the target of said base marker.

* * * * *